US009804539B2

(12) United States Patent
Takahashi et al.

(10) Patent No.: US 9,804,539 B2
(45) Date of Patent: Oct. 31, 2017

(54) IMAGE FORMING APPARATUS AND IMAGE FORMING METHOD

(71) Applicant: CANON KABUSHIKI KAISHA, Tokyo (JP)

(72) Inventors: Shuhei Takahashi, Chiba (JP); Toru Kabashima, Moriya (JP); Jiro Ishizuka, Moriya (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/163,470

(22) Filed: May 24, 2016

(65) Prior Publication Data

US 2016/0349676 A1 Dec. 1, 2016

(30) Foreign Application Priority Data

May 27, 2015 (JP) ..... 2015-107666
May 20, 2016 (JP) ..... 2016-101583

(51) Int. Cl.
*G03G 15/20* (2006.01)
*G03G 9/13* (2006.01)
*G03G 15/10* (2006.01)

(52) U.S. Cl.
CPC ..... *G03G 15/2007* (2013.01); *G03G 9/131* (2013.01); *G03G 15/10* (2013.01)

(58) Field of Classification Search
CPC ..... C23C 16/27; C23C 16/278; C23C 8/10; C07C 2103/86; C07C 2103/90; C07C 35/44; C07C 69/54; G03G 15/2057; G03G 15/206; G03G 15/10; G03G 15/2007; G03G 9/131
See application file for complete search history.

(56) References Cited

U.S. PATENT DOCUMENTS 5,045,420 A 9/1991 Hosono et al.
5,776,543 A 7/1998 Takeuchi et al.
2002/0090238 A1 7/2002 Bartscher et al.
(Continued)

FOREIGN PATENT DOCUMENTS

EP 0 596 668 5/1994
EP 1 437 628 7/2004
(Continued)

*Primary Examiner* — Roy Y Yi
(74) *Attorney, Agent, or Firm* — Fitzpatrick Cella Harper and Scinto

(57) ABSTRACT

The present invention provides an image forming apparatus provided with a fixing apparatus including an infrared irradiation unit for irradiation of a recording medium, on which a liquid developer including a colorant and a cationic polymerizable monomer having a C—H bond is placed, with infrared light, and an ultraviolet irradiation unit for irradiation of the liquid developer with ultraviolet light, wherein when a peak wavelength due to the C—H bond in an infrared absorption spectrum of the cationic polymerizable monomer is defined as λ1 and a half-value wavelength at which a spectral radiant energy density of infrared light emitted from the infrared irradiation unit is 50% (when two of such half-value wavelengths are present, a half-value wavelength at a longer wavelength) is defined as λ2, the peak wavelength λ1 is located at a shorter wavelength than the half-value wavelength λ2.

9 Claims, 8 Drawing Sheets

(56) References Cited

U.S. PATENT DOCUMENTS

| | | | | |
|---|---|---|---|---|
| 2002/0141791 | A1 | 10/2002 | Rohde et al. | |
| 2004/0239854 | A1* | 12/2004 | Monobe | B41M 5/26 349/127 |
| 2016/0091814 | A1* | 3/2016 | Heilman | G03G 9/0926 430/108.6 |

FOREIGN PATENT DOCUMENTS

| | | |
|---|---|---|
| EP | 1 882 585 | 1/2008 |
| JP | 2007-083574 A | 4/2007 |
| JP | 2014-019751 | 2/2014 |
| WO | 2015/001804 | 1/2015 |

* cited by examiner (SECOND EMBODIMENT)

IMAGE FORMING APPARATUS AND IMAGE FORMING METHOD

BACKGROUND OF THE INVENTION

Field of the Invention

The present invention relates to an image forming apparatus and an image forming method.

Description of the Related Art

An image forming apparatus is present which is provided with a fixing apparatus including an ultraviolet irradiation apparatus, in which an ultraviolet curing agent contained in a liquid developer is cured to thereby fix the liquid developer onto a recording medium such as paper. The fixing apparatus including an ultraviolet irradiation apparatus can allow the liquid developer to be almost instantly cured, and therefore is used for drying or the like in a high speed UV offset printing apparatus or an UV inkjet recording apparatus. The fixing apparatus, however, must fix the liquid developer in a shorter time along with an increase in the image output speed of the apparatus, and therefore the illuminance of ultraviolet light from the ultraviolet irradiation apparatus is required to be increased. If the illuminance of ultraviolet light is increased, however, the power consumption of the image forming apparatus tends to be increased.

Japanese Patent Application Laid-Open No. 2007-083574 describes a technique for solving the above problem of an increase in the power consumption in a high-speed machine (image forming apparatus in which the image output speed is high). Specifically, Japanese Patent Application Laid-Open No. 2007-083574 describes the following technique: before irradiation of a liquid developer on a recording medium with ultraviolet light, the recording medium is warmed by a heat plate to heat an ultraviolet curing agent, thereby curing the ultraviolet curing agent at a low illuminance of ultraviolet light.

In the technique described in Japanese Patent Application Laid-Open No. 2007-083574, however, the recording medium is warmed by a heat plate and thus the ultraviolet curing agent is difficult to efficiently heat. The technique then has the following problem: the total of the power consumption of the heat plate and the power consumption of the ultraviolet irradiation apparatus is greater than the power consumption in curing of the ultraviolet curing agent by only the ultraviolet irradiation apparatus.

SUMMARY OF THE INVENTION

In view of the above problem, the present invention is directed to providing an image forming apparatus in which an increase in the total power consumption of a fixing apparatus is suppressed.

According to one aspect of the present invention, there is provided an image forming apparatus provided with a fixing apparatus including an infrared irradiation unit for irradiation of a recording medium, on which a liquid developer including a colorant and a cationic polymerizable monomer having a C—H bond is placed, with infrared light, and an ultraviolet irradiation unit for irradiation of the liquid developer with ultraviolet light, wherein when a peak wavelength due to the C—H bond in an infrared absorption spectrum of the cationic polymerizable monomer is defined as $\lambda 1$ and a half-value wavelength at which a spectral radiant energy density of infrared light emitted from the infrared irradiation unit is 50% (when two of such half-value wavelengths are present, a half-value wavelength at a longer wavelength) is defined as $\lambda 2$, the peak wavelength $\lambda 1$ is located at a shorter wavelength than the half-value wavelength $\lambda 2$.

According to the present invention, the wavelength distribution of infrared light emitted from the infrared irradiation unit overlaps the absorption wavelength distribution of the cationic polymerizable monomer, to thereby allow an increase in the total power consumption of the fixing apparatus to be suppressed. The phrase "the wavelength distribution of infrared light overlaps the absorption wavelength distribution of the cationic polymerizable monomer" is described later.

Further features of the present invention will become apparent from the following description of exemplary embodiments with reference to the attached drawings.

DESCRIPTION OF THE EMBODIMENTS

Figure 1:
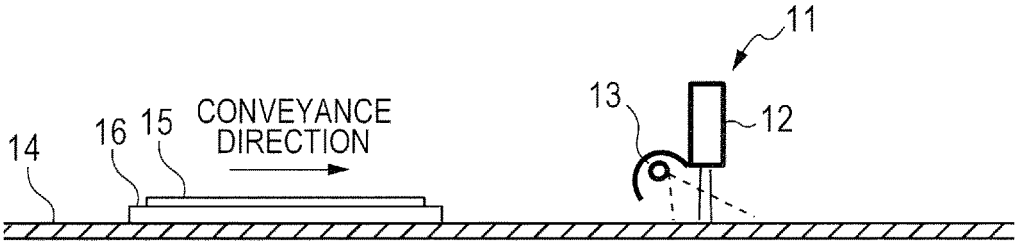
FIG. 1 is a side view illustrating one example of a schematic configuration of the fixing apparatus in the present invention.

Preferred embodiments of the present invention will now be described in detail in accordance with the accompanying drawings.

The image forming apparatus of the present invention is provided with a fixing apparatus including an infrared irradiation unit for irradiation of a recording medium, on which a liquid developer including a colorant and a cationic polymerizable monomer having a C—H bond is placed, with infrared light, and an ultraviolet irradiation unit for irradiation of the liquid developer with ultraviolet light, wherein when the peak wavelength due to the C—H bond in an infrared absorption spectrum of the cationic polymerizable monomer is defined as λ1 and the half-value wavelength at which the spectral radiant energy density of infrared light emitted from the infrared irradiation unit is 50% (when two of such half-value wavelengths are present, the half-value wavelength at a longer wavelength) is defined as λ2, the peak wavelength λ1 is located at a shorter wavelength than the half-value wavelength λ2.

Therefore, an increase in the total power consumption of the fixing apparatus (the total of the power consumption of the infrared irradiation unit and the power consumption of the ultraviolet irradiation unit) can be suppressed.

In the present invention, the cationic polymerizable monomer having a C—H bond is used for an ultraviolet curing agent.

The peak wavelength of infrared light emitted from the infrared irradiation unit can be substantially equal to the peak wavelength of the absorption wavelength of the cationic polymerizable monomer having a C—H bond. The phrase "substantially equal to" is described later.

The liquid developer can include a cationic polymerizable monomer having a C—H bond, a photopolymerization initiator, and a toner particle that includes a colorant and that is insoluble in the cationic polymerizable monomer.

The cationic polymerizable monomer is preferably a monomer having not only a C—H bond but also a C=C bond, more preferably a vinyl ether compound.

The photopolymerization initiator can be a compound represented by the following formula (1).

(1)

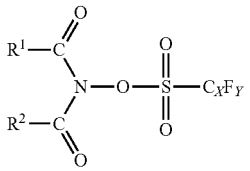

In the formula (1), $R^1$ and $R^2$ are bound to each other to form a ring structure, X represents the number of carbon atoms and represents an integer of 1 to 8, and Y represents the number of fluorine atoms and represents an integer of 3 to 17.

The liquid developer contains the photopolymerization initiator represented by the formula (1), and thus an ionic photo-acid generator, which can allow for good fixing, but simultaneously tends to deteriorate the electric resistance of the liquid developer, is not necessarily required to be used.

The compound represented by the formula (1) that is the photopolymerization initiator is irradiated with ultraviolet light and thus photolyzed to generate sulfonic acid that is a strong acid. The liquid developer can also further contain a sensitizer to allow absorption of ultraviolet light by the sensitizer to act as a trigger, thereby performing decomposition of the photopolymerization initiator and generation of sulfonic acid.

Examples of the ring structure formed by binding $R^1$ and $R^2$ include a 5-membered ring and a 6-membered ring. The ring structure may also have a substituent such as an alkyl group, an alkyloxy group, an alkylthio group, an aryl group and an aryloxy group. Other ring structure such as an alicyclic ring, a heterocyclic ring and an aromatic ring having or not having a substituent may also be fused to the ring structure.

A $C_XF_Y$ group large in electron-withdrawing properties is a fluorocarbon group, and is a functional group that is irradiated with ultraviolet light to thereby decompose a sulfonic acid ester moiety. X in the $C_XF_Y$ group represents the number of carbon atoms and can represent an integer of 1 to 8 (X=1 to 8). In addition, Y in the $C_XF_Y$ group represents the number of fluorine atoms and can represent an integer of 3 to 17 (Y=3 to 17).

When the number of carbon atoms is 1 or more, generation (synthesis) of a strong acid is easily performed. When the number of carbon atoms is 8 or less, storage stability is excellent. When the number of fluorine atoms is 3 or more, the action as a strong acid is excellent. When the number of fluorine atoms is 17 or less, generation (synthesis) of a strong acid is easily performed.

In the formula (1), the $C_XF_Y$ group includes a linear alkyl group (RF1) in which a hydrogen atom is substituted with a fluorine atom, a branched alkyl group (RF2) in which a hydrogen atom is substituted with a fluorine atom, a cycloalkyl group (RF3) in which a hydrogen atom is substituted with a fluorine atom, and an aryl group (RF4) in which a hydrogen atom is substituted with a fluorine atom.

Examples of RF1 include a trifluoromethyl group (X=1, Y=3), a pentafluoroethyl group (X=2, Y=5), a heptafluoro-n-propyl group (X=3, Y=7), a nonafluoro-n-butyl group (X=4, Y=9), a perfluoro-n-hexyl group (X=6, Y=13) and a perfluoro-n-octyl group (X=8, Y=17).

Examples of RF2 include a perfluoroisopropyl group (X=3, Y=7), a perfluoro-tert-butyl group (X=4, Y=9) and a perfluoro-2-ethylhexyl group (X=8, Y=17).

Examples of RF3 include a perfluorocyclobutyl group (X=4, Y=7), a perfluorocyclopentyl group (X=5, Y=9), a perfluorocyclohexyl group (X=6, Y=11) and a perfluoro(1-cyclohexyl)methyl group (X=7, Y=13).

Examples of RF4 include a pentafluorophenyl group (X=6, Y=5) and a 3-trifluoromethyltetrafluorophenyl group (X=7, Y=7).

As the $C_XF_Y$ group in the formula (1), RF1, RF2 and RF4 are preferable and in particular RF1 and RF4 are more preferable in terms of availability of the compound represented by the formula (1) and decomposition properties of a sulfonic acid ester moiety. A trifluoromethyl group (X=1, Y=3), a pentafluoroethyl group (X=2, Y=5), a heptafluoro-n-propyl group (X=3, Y=7), a nonafluoro-n-butyl group (X=4, Y=9) and a pentafluorophenyl group (X=6, Y=5) are particularly preferable.

Examples of the cationic polymerizable monomer include dicyclopentadiene vinyl ether, cyclohexanedimethanol divinyl ether, tricyclodecane vinyl ether, trimethylolpropane trivinyl ether, 2-ethyl-1,3-hexanediol divinyl ether, 2,4-diethyl-1,5-pentanediol divinyl ether, 2-butyl-2-ethyl-1,3-propanediol divinyl ether, neopentyl glycol divinyl ether, pentaerythritol tetravinyl ether and 1,2-decanediol divinyl ether.

Hereinafter, embodiments of the present invention are described with reference to the drawings.

First Embodiment

FIG. 1 is a side view illustrating a schematic configuration of the fixing apparatus in the present invention.

As illustrated in FIG. 1, a fixing apparatus 11 includes an ultraviolet irradiation apparatus 12 and an infrared irradiation apparatus 13. A recording medium 16 on which a liquid developer 15 is carried is placed on a conveyance belt 14 and conveyed, and the liquid developer 15 is irradiated with infrared light by the infrared irradiation apparatus 13 and the liquid developer 15 is irradiated with ultraviolet light by the ultraviolet irradiation apparatus 12.

Figure 2:
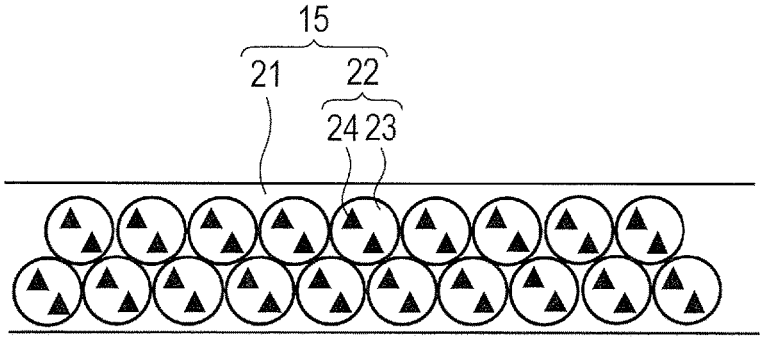
FIG. 2 is a cross-sectional view of a liquid developer to be cured by ultraviolet light.

FIG. 2 is a cross-sectional view of a liquid developer to be cured by ultraviolet light.

A liquid developer 15 illustrated in FIG. 2 includes an ultraviolet curing agent 21 and a toner particle 22. The ultraviolet curing agent 21 of the liquid developer 15 illustrated in FIG. 2 includes a cationic polymerizable monomer and a photopolymerization initiator. The toner particle 22 includes a binder resin (toner resin) and a colorant 24, and is insoluble in the cationic polymerizable monomer. In cation polymerization, when the ultraviolet curing agent 21 is irradiated with ultraviolet light, the photopolymerization initiator excited by ultraviolet light generates an acid, and initiates a polymerization reaction of the acid generated with the cationic polymerizable monomer to cure the ultraviolet curing agent.

The ultraviolet irradiation apparatus in FIG. 1 includes an LED (Light Emitting Diode) for irradiation with ultraviolet light as an ultraviolet light source. It is important for an ultraviolet curing reaction to satisfy the first law of photochemistry (Grotthuss-Drapper Law), namely, to allow "photochemical change to occur by only the fraction of light absorbed, of the amount of light projected". That is, it is important for ultraviolet curing that the absorption wavelength of the photopolymerization initiator is equal to the wavelength of ultraviolet light. Since an LED light source having peak wavelengths (peak illuminances) at 365±5 nm, 385±5 nm and 405±5 nm as wavelengths of the LED is prevalent, the photopolymerization initiator can have absorption at such wavelength regions.

Figure 3:
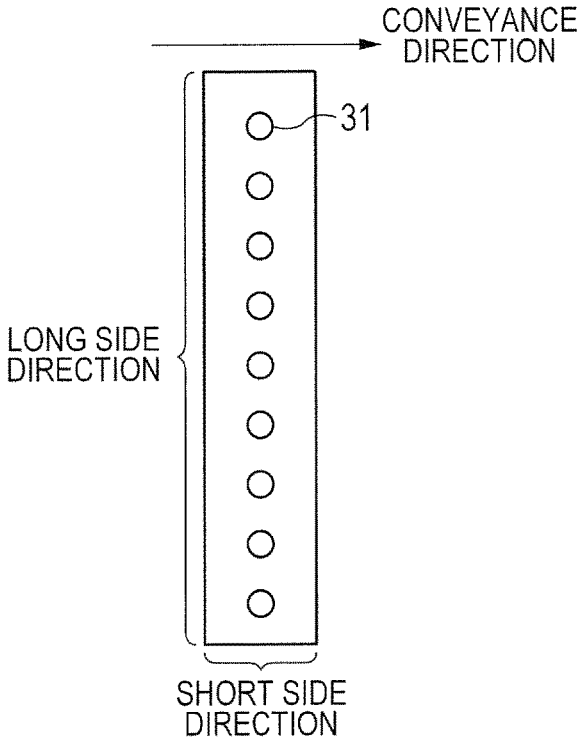
FIG. 3 is a view illustrating one example of an array of LEDs with which an ultraviolet irradiation apparatus is provided.

FIG. 3 is a view illustrating one example of an array of LEDs which the ultraviolet irradiation apparatus includes.

LEDs 31 for irradiation with ultraviolet light may be aligned in a row or in a plurality of rows in the long side direction perpendicular to the conveyance direction of a recording medium. The LEDs 31 for irradiation with ultraviolet light are arranged on a surface opposite to the conveyance belt 14.

Figure 5:
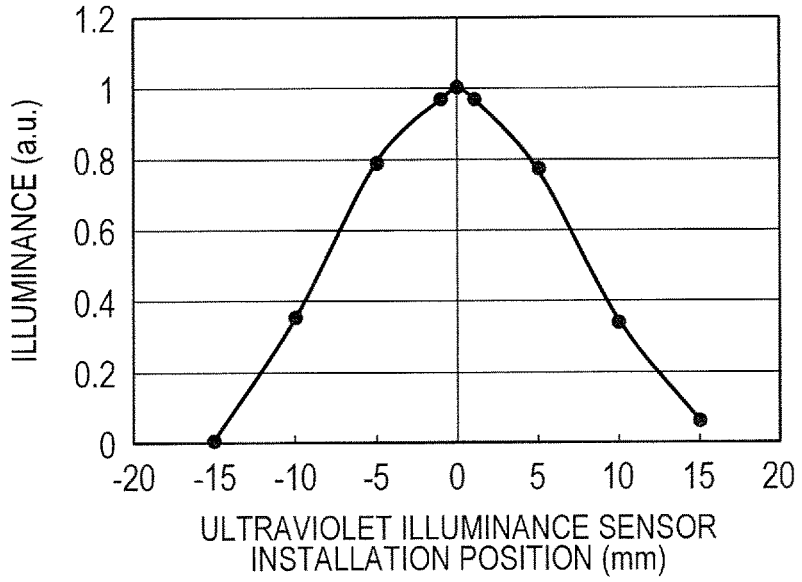
FIG. 5 is a graph illustrating the distribution in the conveyance direction of the illuminance of an ultraviolet irradiation apparatus.

FIG. 5 is a graph illustrating the distribution in the conveyance direction of the illuminance of an ultraviolet irradiation apparatus where the illuminance strength of the illuminance peak of ultraviolet light is 1.8 W/cm$^2$ and the illuminance peak is at a wavelength in the range of 385±5 nm. Herein, the unit [a.u.] in FIG. 5 represents an arbitrary unit. Much the same is true on FIGS. 6, 8, 11 and 12.

In FIG. 5, the maximum illuminance at a position immediately below an LED (ultraviolet illuminance sensor installation position: 0 (mm)) and at a position of the surface of a recording medium as an object to be conveyed is referred to as the peak illuminance. Ultraviolet illuminance sensor installation positions of 5 mm, 10 mm, mm and 20 mm mean positions that proceed from the position immediately below an LED in the conveyance direction by 5 mm, 10 mm, 15 mm and 20 mm, respectively.

The irradiation energy to be received per unit area means the total amount of a photon that reaches the surface, namely, the "integrated amount of light (mJ/cm$^2$)", and is obtained by integration of the integrated illuminance (mW/cm$^2$) of respective wavelengths in the ultraviolet irradiation apparatus and the irradiation time (s) ((mW/cm$^2$)×(s)).

As described above, as the conveyance speed of the recording medium to be conveyed is higher, the time during which the recording medium is irradiated (irradiation time) is shorter, and as a result, the "integrated amount of light (mJ/cm$^2$)" is smaller and the liquid developer is less cured. Therefore, in order that, as a higher-speed machine is used, the integrated amount of light to be required for curing of the developer is smaller, the ultraviolet curing agent is required to be optimized or a light source whose ultraviolet irradiation apparatus has a higher illuminance (mW/cm$^2$) is required to be selected.

The infrared irradiation apparatus 13 illustrated in FIG. 1 is an apparatus in which irradiation with infrared light having a wavelength (wavelength of about 1 to 15 μm) in the far-infrared region is conducted by a light source. The vibration absorption wavelength of a chemical bond of an organic substance having a C—H bond is generally in the far-infrared region, and therefore the organic substance can be efficiently heated by irradiation with far-infrared light. For example, a C—H bond absorbs infrared light having a wavelength of about 3.0 μm. A C═O bond absorbs infrared light having a wavelength of about 5.9 μm.

Examples of an apparatus for irradiation with infrared light (far-infrared light) in the far-infrared region include a halogen heater, a quartz tube heater and a ceramic heater.

The halogen heater is a heater in which electricity is applied to a tungsten filament to thereby heat the filament, allowing for irradiation with infrared light (far-infrared light) having a wavelength of about 800 nm to 3,000 nm.

The quartz tube heater is a heater in which electricity is applied to a nichrome wire filament to thereby heat the filament, allowing for irradiation with infrared light (far-infrared light) having a wavelength of about 2,500 nm to 7,000 nm.

When the ceramic heater is an alumina ceramic heater, irradiation with infrared light (far-infrared light) having a long wavelength (wavelength of 6,000 nm or more) can be conducted.

The infrared light emitted from the filament is reflected by a metal (reflective mirror) having a high reflectance in the infrared region. The infrared light reflected is applied to (for irradiation of) the liquid developer on the recording medium to thereby promote the molecular vibration in the liquid developer, resulting in an increase in the temperature of the liquid developer. For example, a reflective plate made of high-purity aluminum can have a high reflectance in the infrared region to allow the infrared light to be efficiently reflected.

Figure 6:
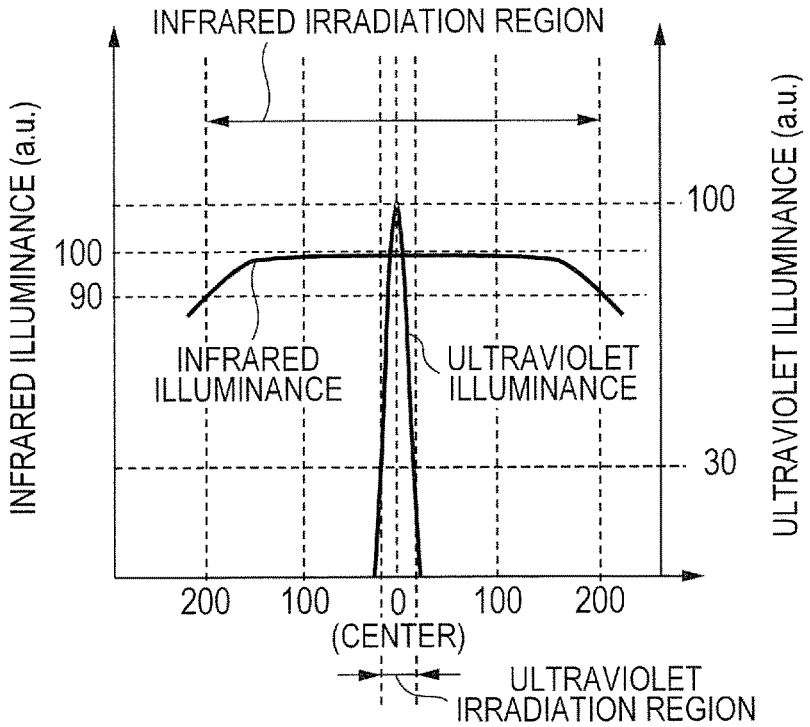
FIG. 6 is a graph illustrating a relationship among the infrared irradiation region, the ultraviolet irradiation region, the infrared illuminance and the ultraviolet illuminance.

FIG. 6 illustrates the temperature distribution of the liquid developer at a position apart from the heater by 450 mm.

FIG. 6 is a graph illustrating a relationship among the infrared irradiation region, the ultraviolet irradiation region, the infrared illuminance and the ultraviolet illuminance.

The infrared irradiation region is defined as a region achieving 90% or more of the peak illuminance. The ultraviolet irradiation region is defined as a region achieving 30% or more of the peak illuminance. While the infrared irradiation region is wider than the ultraviolet irradiation region, the infrared irradiation region can be varied by the change in the shape of the reflective mirror.

Figure 4:
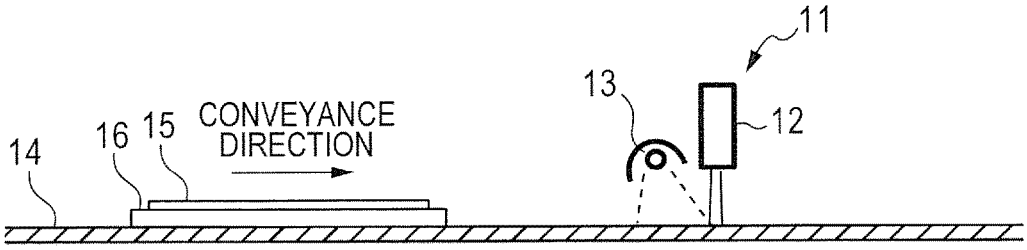
FIG. 4 is a side view illustrating another example of the schematic configuration of the fixing apparatus in the present invention.

As illustrated in FIG. 4, the center of the infrared irradiation region may also be positioned upstream the center of the ultraviolet irradiation region (left in FIG. 4).

Hereinafter, a case where the center of the infrared irradiation region is positioned upstream the center of the ultraviolet irradiation region is studied, and the result is described.

In FIG. 1, a transparent or opaque, non-absorbable resin film for use in soft packaging, besides common paper (plain paper), can be applied as the recording medium. Examples of the resin of the resin film include polyethylene terephthalate, polyester, polyimide, polypropylene, polystyrene and polycarbonate.

Figure 7:
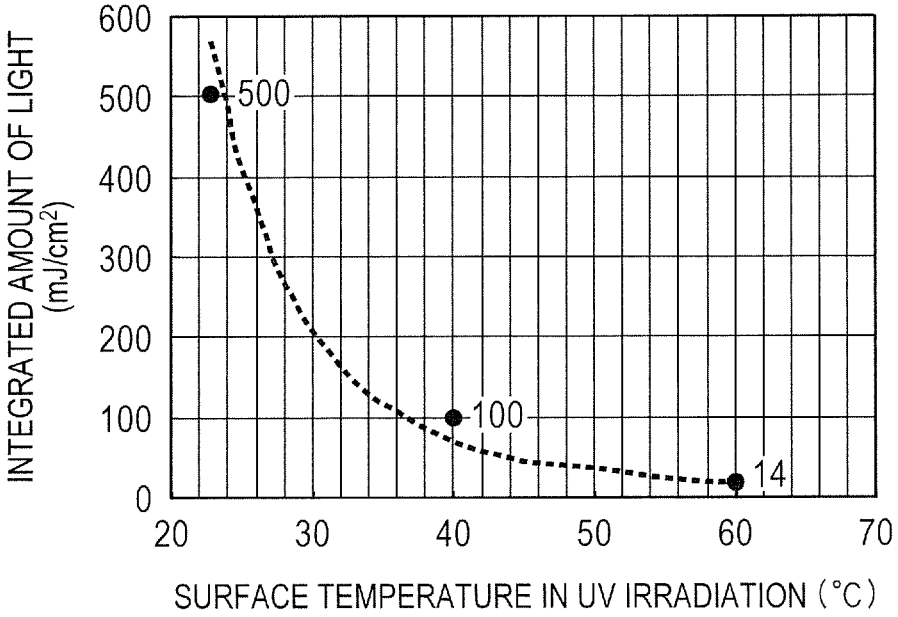
FIG. 7 is a graph illustrating the integrated amount of light to be required for curing versus the surface temperature of a liquid developer in irradiation with ultraviolet light.

FIG. 7 is a graph illustrating the integrated amount of light ($mJ/cm^2$) to be required for curing versus the surface temperature of the liquid developer in irradiation with ultraviolet light.

In FIG. 7, the ultraviolet irradiation apparatus is for irradiation with ultraviolet light where the maximum value of the spectral illuminance is within the range of 385±5 nm. As illustrated in FIG. 7, when the surface temperature in UV irradiation (the surface temperature of the liquid developer in irradiation with ultraviolet light) is raised, the integrated amount of light ($mJ/cm^2$) to be required for curing is smaller.

A cationic polymerizable monomer (ultraviolet curing agent) having a C—H bond included in the liquid developer is obtained by mixing about 10% by mass of a monofunctional monomer having one vinyl ether group, represented by the following formula (2), and about 90% by mass of a bifunctional monomer having two vinyl ether groups, represented by the following formula (3).

A compound represented by the following formula (4) is contained as the photopolymerization initiator in an amount of 0.1% by mass relative to the cationic polymerizable monomer having a C—H bond. When the photopolymerization initiator is used, an ionic photo-acid generator, which can allow for good fixing, but simultaneously tends to reduce the resistance of the liquid developer, is not necessarily required to be used.

(2)

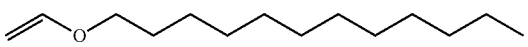

(3)

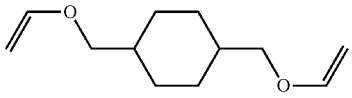

(4)

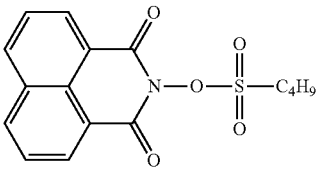

Comparative Example

Comparative Example is the same as First Embodiment except that the halogen heater is used as the heater instead of using the quartz tube heater. The recording medium 16 on which the liquid developer 15 is carried is placed on the conveyance belt 14 and conveyed, and the liquid developer 15 is irradiated with infrared light by the infrared irradiation apparatus 13 and the liquid developer 15 is irradiated with ultraviolet light by the ultraviolet irradiation apparatus 12.

The liquid developer 15 includes an ultraviolet curing agent 21 and a toner particle 22. The ultraviolet curing agent includes a cationic polymerizable monomer and a photopolymerization initiator. The toner particle includes a binder resin (toner resin) 23 and a colorant 24, and is insoluble in the cationic polymerizable monomer.

Figure 8:
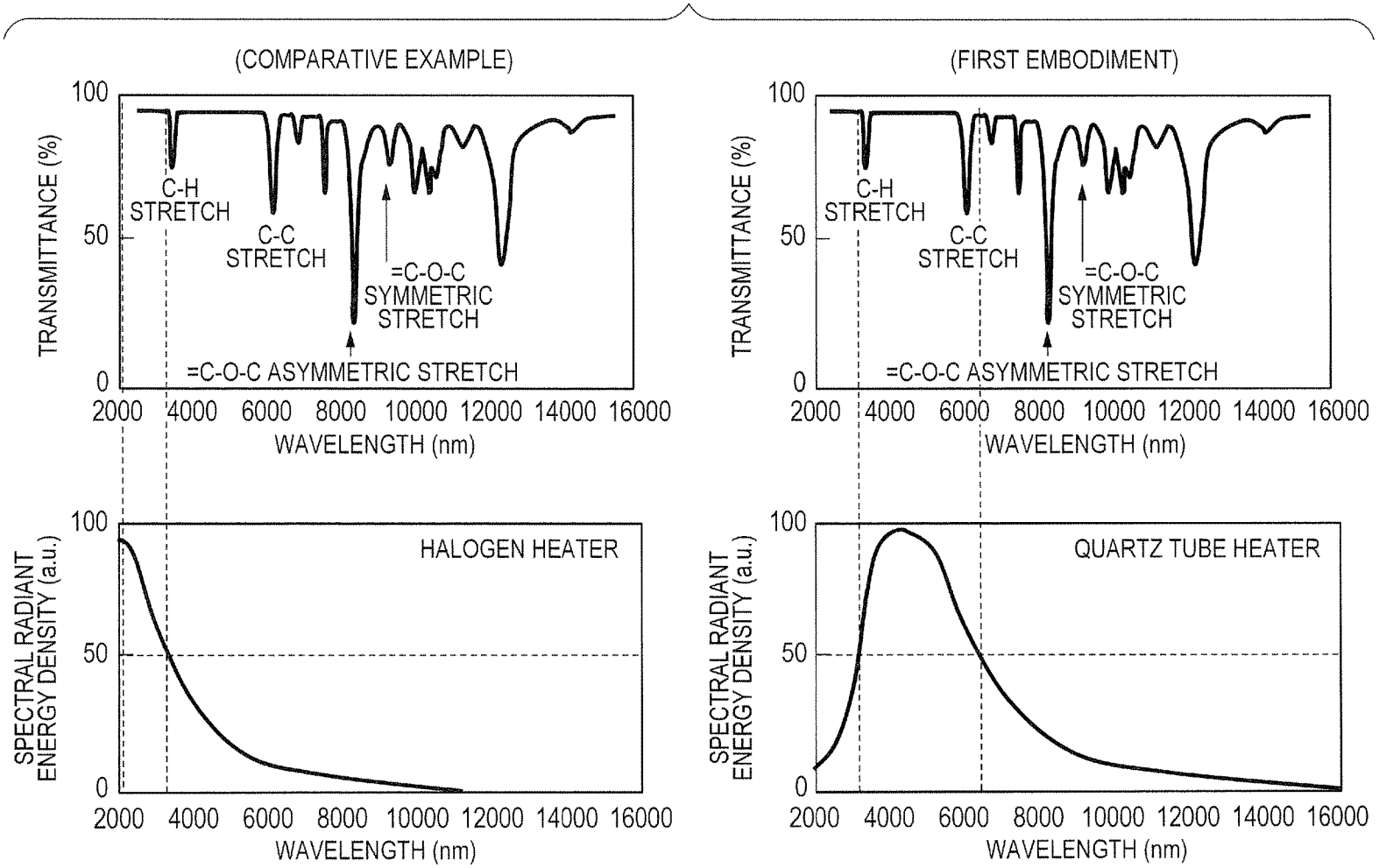
FIG. 8 is a diagram illustrating the wavelength distribution of irradiation light from an infrared irradiation apparatus and the wavelength distribution of absorption of a developer in each of First Embodiment and Comparative Example.

FIG. 8 is a diagram illustrating the wavelength distribution of irradiation light from the infrared irradiation apparatus and the wavelength distribution of absorption of the developer in each of First Embodiment and Comparative Example. The absorption peak is at the absorption wavelength of the cationic polymerizable monomer.

In First Embodiment, the quartz tube heater is used. In such a case, the emission wavelength of infrared light overlaps the absorption wavelength distribution of the cationic polymerizable monomer, and therefore the temperature of the developer can be efficiently raised.

Here, the phrase "the emission wavelength of infrared light overlaps the absorption wavelength distribution of the cationic polymerizable monomer" means that when, in an infrared absorption spectrum of the cationic polymerizable monomer having a C—H bond, the peak wavelength due to the C—H bond is defined as $\lambda 1$ and the half-value wavelength in which the spectral radiant energy density of infrared light emitted from the infrared irradiation unit is 50% (when two of such half-value wavelengths are present, the half-value wavelength at a longer wavelength) is defined as $\lambda 2$, the peak wavelength $\lambda 1$ is located at a shorter wavelength than the half-value wavelength $\lambda 2$.

In Comparative Example, the halogen heater is used. In such a case, the emission wavelength of infrared light does not overlap the absorption wavelength distribution of the cationic polymerizable monomer included in the liquid developer (the peak wavelength ($\lambda 1$) due to the C—H bond is located at a longer wavelength than the half-value wavelength ($\lambda 2$) in which the spectral radiant energy density of the infrared irradiation apparatus is 50%), and therefore the temperature of the liquid developer cannot be efficiently raised.

For example, when a power of 1,500 W is input to the heater, the surface temperature of the liquid developer can be heated only to 40° C. in Comparative Example (raised by 17° C. relative to room temperature of 23° C.).

In First Embodiment, however, not only C—H stretch, but also C=C stretch can be heated and therefore the surface temperature can be heated to 50° C. (raised by 27° C. relative to room temperature of 23° C.). In First Embodiment, the area where the infrared absorption spectrum overlaps the infrared radiation spectrum is about 2 to 3 times larger than such an area in Comparative Example, and thus it is considered that the temperature of the liquid developer is also raised about 2 to 3 times. The recording medium, however, is conveyed at 800 mm/s, and thus it is considered that the temperature of the liquid developer is actually raised about 1.6 times (=27° C./17° C.).

As described above, irradiation with infrared light is performed in a specific condition to thereby increase the temperature of the liquid developer, and therefore the integrated amount of light to be required can be decreased from 100 $mJ/cm^2$ to 40 $mJ/cm^2$ with respect to irradiation with ultraviolet light. The reaction rate constant k is considered to be determined by the Arrhenius equation "$k=\exp(-E/RT)$". E represents the activation energy (J/mol) of the reaction, T represents the absolute temperature (K) of the environment and R represents the gas constant. The temperature is raised by 10° C. to thereby allow the reaction rate to be twice as fast, and therefore such an event approximately corresponds to a decrease in the integrated amount of light to be required, to ⅖. Herein, the integrated amount of light ($J/cm^2$) is determined by (irradiation power ($W/cm^2$))×(irradiation time (s)). Accordingly, an equal power to be applied for irradiation with ultraviolet light can decrease the irradiation time of ultraviolet light, thereby allowing the power consumption of the ultraviolet irradiation apparatus to be decreased to ⅖.

Specifically, a case is described where the power consumption of the infrared irradiation apparatus is 1,500 W and the power consumption of the ultraviolet irradiation apparatus is 1,500 W (a case of 50° C.)

The case is studied at a conveyance speed of the recording medium of 800 mm/sec and at an irradiation width of 350 mm.

In Comparative Example (where the surface temperature of the liquid developer is 40° C.), the total power consumption of the fixing apparatus is required to be 1,500 W (infrared irradiation apparatus)+1,500 W×2.5 (times) (ultraviolet irradiation apparatus)=5,250 W.

On the contrary, in First Embodiment, the total power consumption of the fixing apparatus is 1,500 W (infrared irradiation apparatus)+1,500 W (ultraviolet irradiation apparatus)=3,000 W (50° C.), and therefore the total power consumption of the fixing apparatus is suppressed.

Figure 9:
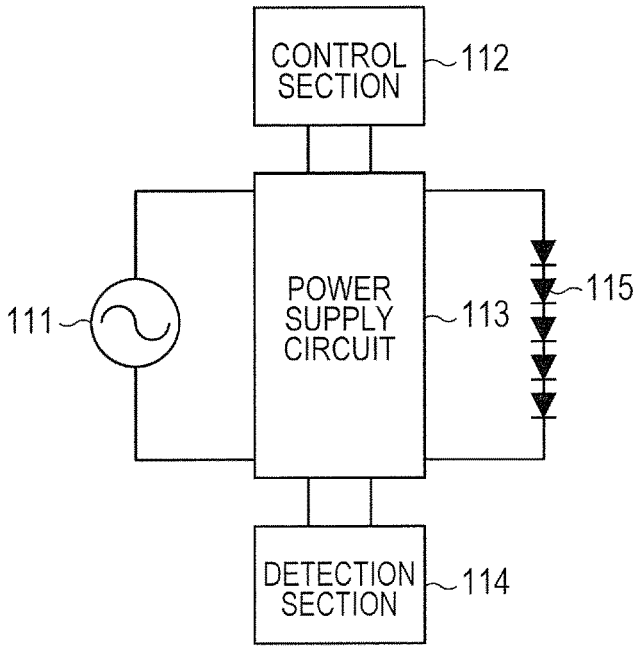
FIG. 9 is a view for describing a power supply control circuit of an ultraviolet LED.

FIG. 9 is a view for describing a power supply control circuit of an ultraviolet LED. The power supply control circuit is configured from an AC power supply 111, a control section 112, a power supply circuit 113, a detection section 114 and an LED 115.

The control section is a circuit that controls the power supply of the power supply circuit. The power supply circuit is configured from an AC/DC converter that converts an alternating current to a direct current, and a circuit that turns the LED ON/OFF. The detection section is configured from, for example, a detector that senses the presence of a recording medium immediately below the ultraviolet irradiation unit.

Figure 10:
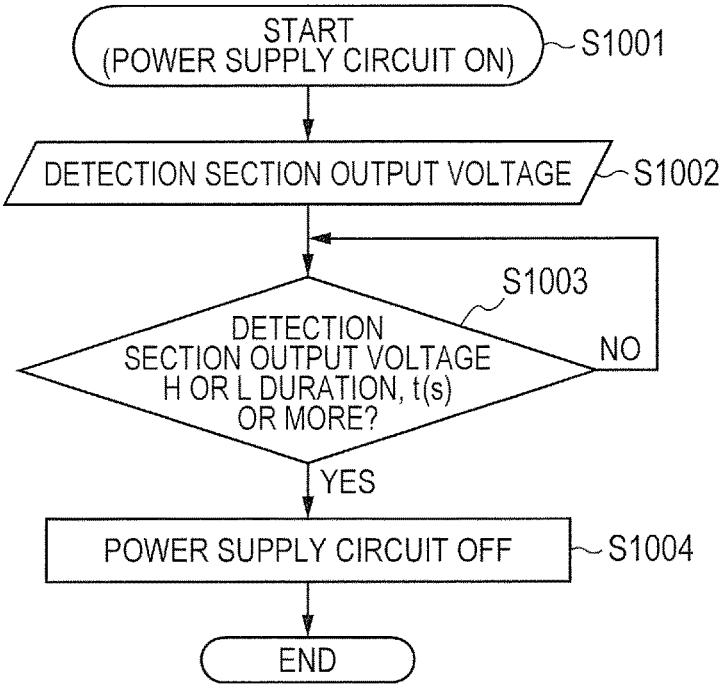
FIG. 10 is a flowchart for describing detection flow in jamming of a recording medium in an image forming apparatus.

FIG. 10 is a flowchart for describing detection flow in jamming of a recording medium such as paper in an image forming apparatus.

S1001: the power supply circuit of the ultraviolet irradiation apparatus of the fixing apparatus is turned ON and the power supply of the detection section is also turned ON.

S1002: the output voltage of the detection section is output. The output voltage of the detection section is switched depending on the presence of a recording medium on the conveyance belt. For example, a sensor that allows the conveyance belt and the recording medium to be irradiated with infrared light and that detects the infrared light reflected is used for the sensor of the detection section. A case is described where when the recording medium is present, the detection section outputs H. In the case of printing for a usual number of recording mediums, a portion of the conveyance belt, exposed between the recording mediums, is present, and therefore an output signal of H (recording medium) is switched to an output signal of L (conveyance belt). That is, the output signal of the detection section is usually switched from H to L at a timing of sensing the portion between the recording mediums. When the recording mediums are jammed, the output of H is continued.

S1003: whether or not the time during which the voltage of H is continuously output from the detection section (hereinafter, also designated as "H voltage continuous output time".) is equal to or more than t sec. as a time that is a predetermined multiple (for example, 10) of the "time required for passing of the recording medium" determined depending on the size and the conveyance speed of the recording medium for printing is monitored.

S1004: when continuance of the H voltage continuous output time for t sec. or more is detected in S1003, the power supply circuit of the ultraviolet irradiation apparatus is turned OFF. On the other hand, when the H voltage continuous output time is switched from H to L at an interval of less than t sec., the H voltage continuous output time is reset to 0 and the power supply of the detection section is continuously turned ON. Also when detection of the sensor is stopped at a position on the conveyance belt, the output signal of the detection section remains at L and the power supply is turned OFF also in the case. As such a switching method, a relay switch or the like is used.

The recording medium and the conveyance belt can be continuously irradiated with ultraviolet light by the above method to thereby suppress degradation of the recording medium, contamination in the image forming apparatus, and degradation of the conveyance belt.

Second Embodiment

Figure 11:
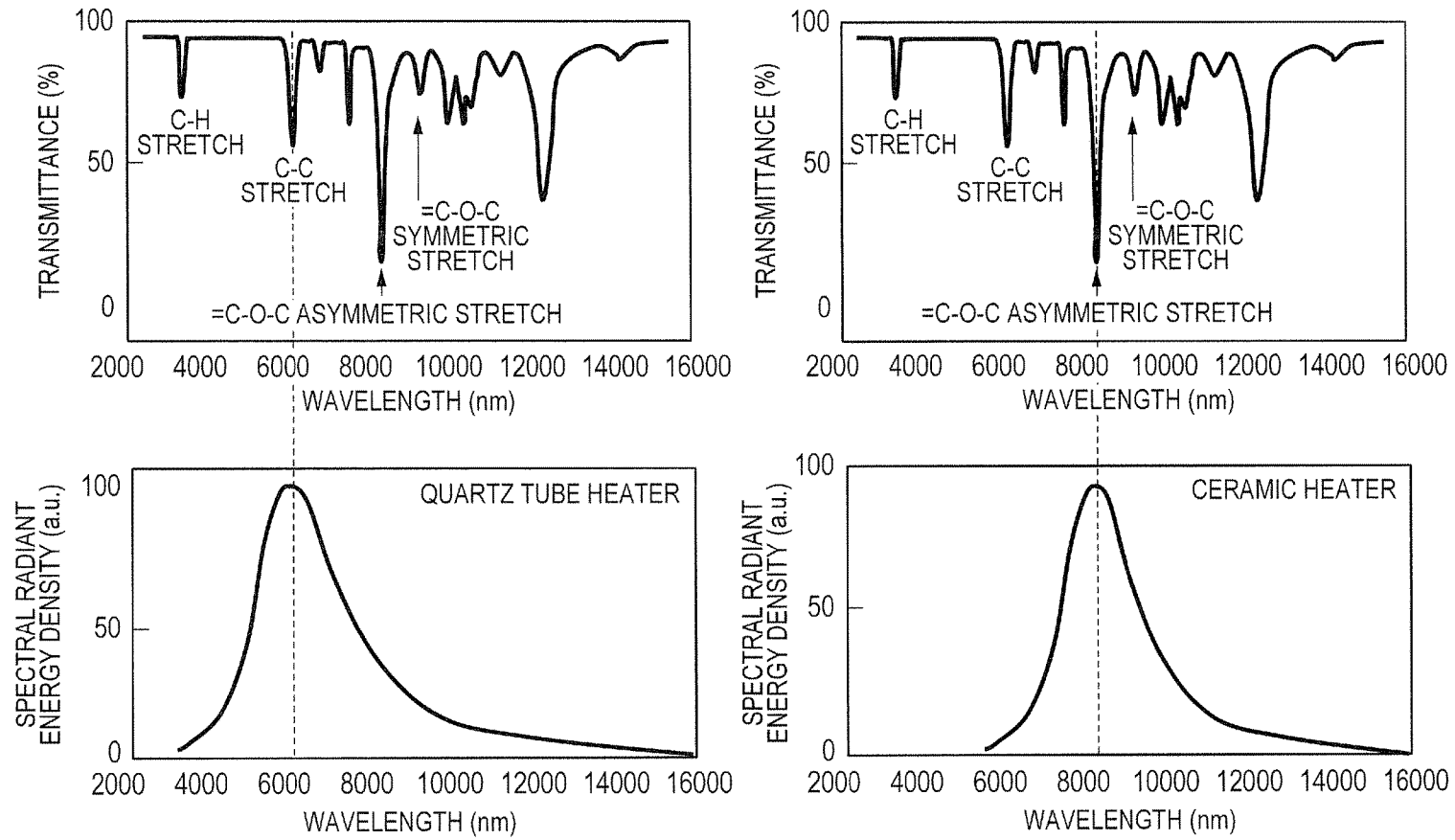
FIG. 11 is a diagram illustrating the wavelength distribution of irradiation light from an infrared irradiation apparatus and the wavelength distribution of absorption of a developer in Second Embodiment.

FIG. 11 is a diagram illustrating the wavelength distribution of irradiation light from the infrared irradiation apparatus and the wavelength distribution of absorption of the liquid developer in Second Embodiment.

Second Embodiment is different from First Embodiment in that the peak wavelength of infrared light emitted from the infrared irradiation unit is substantially equal to the peak wavelength of the absorption wavelength of the cationic polymerizable monomer. Other configuration is the same as in First Embodiment, and therefore description is omitted. The phrase "substantially equal to" is described later.

In Second Embodiment, the cationic polymerizable monomer in the liquid developer can absorb infrared light at a longer wavelength than the wavelength in First Embodiment. Therefore, while irradiation with infrared light at 1500 W can allow the temperature to be raised to 50° C. in First Embodiment, such irradiation can allow the temperature to be raised to 60° C. in Second Embodiment.

For example, a case is described where the power consumption of the infrared irradiation apparatus is 1,500 W and the power consumption of the ultraviolet irradiation apparatus is 1500 W (40 mJ/cm$^2$).

In First Embodiment (where the surface temperature of the liquid developer is 50° C.), the total power consumption of the fixing apparatus is required to be 1500 W (infrared irradiation apparatus)+1500 W (ultraviolet irradiation apparatus)=3,000 W.

On the contrary, in Second Embodiment, the liquid developer is irradiated with infrared light at a wavelength where the absorption is larger, and therefore the temperature of the liquid developer is raised to 60° C. Therefore, the integrated illuminance of the ultraviolet irradiation apparatus is 14 mJ/cm$^2$, and is about ⅓ of the integrated illuminance at 50° C. That is, the total power consumption of the fixing apparatus is 1500 W (infrared irradiation apparatus)+1500 W (ultraviolet irradiation apparatus)×(⅓)=2,000 W (60° C.). The temperature of the developer is 50° C. at 3,000 W in First Embodiment, and therefore the total power consumption of the fixing apparatus can be more suppressed in Second Embodiment.

TABLE 1

| | Comparative Example | First Embodiment | Second Embodiment |
|---|---|---|---|
| Heating source | Halogen heater | Quartz tube heater | Quartz tube heater (Ceramic heater) |

TABLE 1-continued

| | Comparative Example | First Embodiment | Second Embodiment |
|---|---|---|---|
| Surface temperature of developer (° C.) | 40 | 50 | 60 |
| Power of infrared irradiation apparatus (W) | 1,500 | 1,500 | 1,500 |
| Power of ultraviolet irradiation apparatus (W) | 3,750 | 1,500 | 500 |
| Total power (W) | 5,250 | 3,000 | 2,000 |

Figure 12:
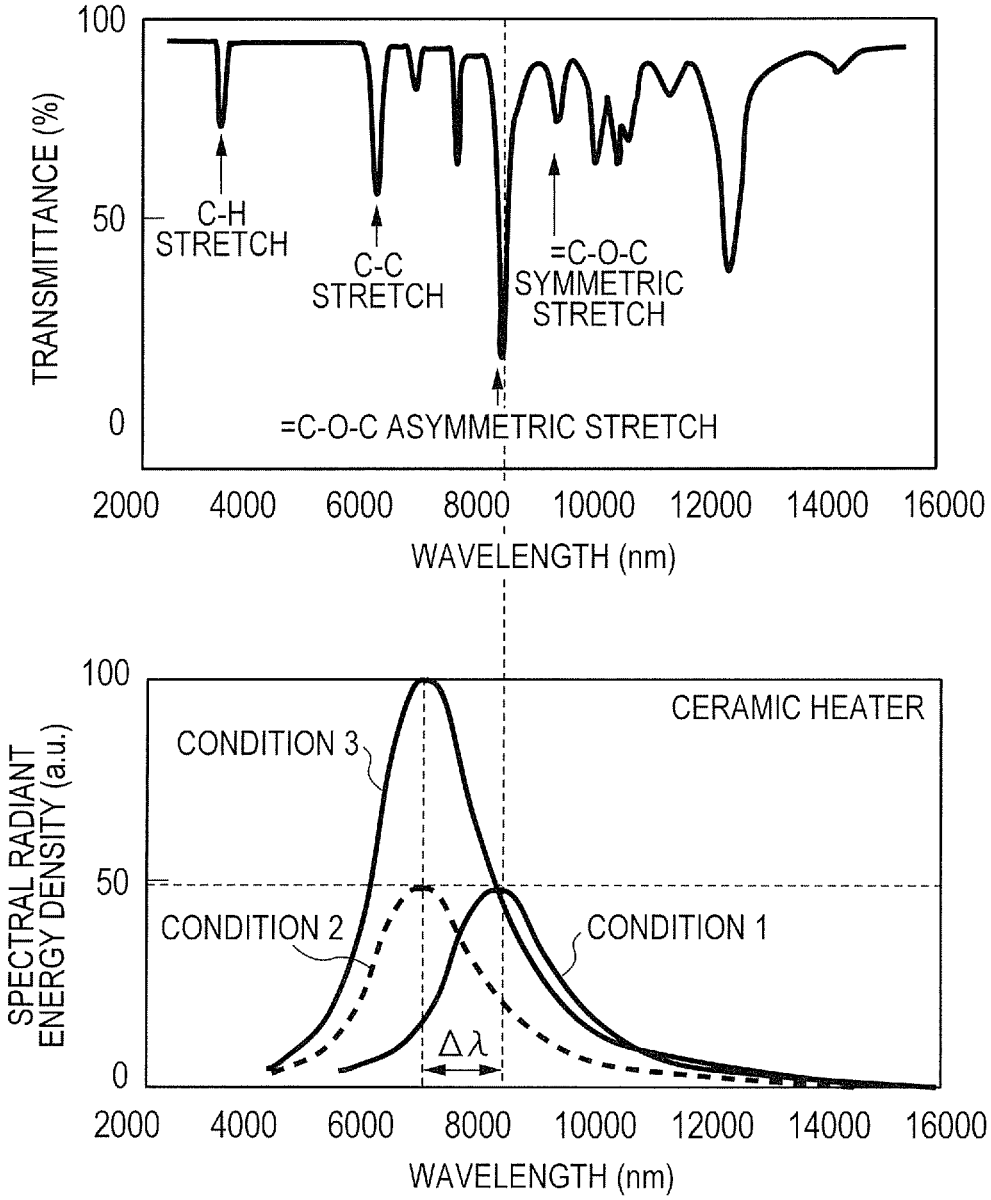
FIG. 12 is a diagram illustrating the variation in wavelength of infrared light.

FIG. 12 is a diagram illustrating the peak wavelength of infrared light emitted from the infrared irradiation unit being substantially equal to the peak wavelength of the absorption wavelength of the cationic polymerizable monomer. In an example illustrated in FIG. 12, a vinyl ether compound is used as the cationic polymerizable monomer.

A case where the peak wavelength in the infrared heater for irradiation is equal to the absorption wavelength of ═C—O—C(asymmetric stretch) of the cationic polymerizable monomer is defined as Condition 1.

A case where the peak wavelength in the infrared heater for irradiation is shorter than the absorption wavelength of ═C—O—C(asymmetric stretch) of the cationic polymerizable monomer by Δλ is defined as Condition 2.

In Condition 1,
when the power of the ultraviolet irradiation apparatus is defined as E (UV (1)) and
the power of the infrared irradiation apparatus is defined as E (IR (1)),
the total power consumption is expressed by
E (UV (1))+E (IR (1)).

In Condition 2,
when the power of the ultraviolet irradiation unit is defined as E (UV (2)),
the power of the infrared irradiation apparatus is defined as E (IR (2)) and
the power of the infrared irradiation apparatus satisfies E (IR (2))=E (IR (1)), heating is insufficient, and therefore
the power E (UV (2)) of the ultraviolet irradiation apparatus is required to be increased by ΔE (UV) to satisfy E (UV (1))+ΔE (UV).

Accordingly, the total power consumption in Condition 2 is expressed by
E (UV (1))+E (IR (1))+ΔE (UV).

A case where the power of the ultraviolet irradiation apparatus remains at E (UV (1)) in a condition of a shorter peak wavelength by Δλ is defined as Condition 3.

In Condition 3,
when the power of the ultraviolet irradiation apparatus is defined as E (UV (3)),
the power of the infrared irradiation apparatus is defined as E (IR (3)) and
the power of the ultraviolet irradiation apparatus satisfies E (UV (3))=E (UV (1)),
the power E (IR (3)) of the infrared irradiation apparatus is required to be increased by ΔE (IR) to satisfy E (IR (1))+ΔE (IR).

Accordingly, the total power consumption in Condition 3 is expressed by
E (UV (1))+E (IR (1))+ΔE (IR).

In the phrase "the peak wavelength of infrared light emitted from the infrared irradiation unit is substantially equal to the peak wavelength of the absorption wavelength of the cationic polymerizable monomer", the sub-phrase "substantially equal to" means that the total power consumption: E (UV (1))+E (IR (1))+ΔE (UV) in Condition 2; is
equal to or less than the total power consumption: E (UV (1))+E (IR (1))+ΔE (IR); in Condition 3, namely, is expressed by ΔE (UV) ΔE (IR).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-107666, filed May 27, 2015, and Japanese Patent Application No. 2016-101583, filed May 20, 2016, which are hereby incorporated by reference herein in their entirety.

What is claimed is:

1. An image forming apparatus provided with a fixing apparatus comprising:

an infrared irradiation unit for irradiating with infrared light a recording medium bearing a liquid developer comprising a colorant and a cationic polymerizable monomer having a C-H bond: and an ultraviolet irradiation unit for irradiating with ultraviolet light the liquid developer, wherein when a peak wavelength due to the C-H bond in an infrared absorption spectrum of the cationic polymerizable monomer is defined as λ1 and a half-value wavelength at which a spectral radiant energy density of infrared light emitted from the infrared irradiation unit is 50%, when two of such half-value wavelengths are present, a half-value wavelength at a longer wavelength, is defined as λ2, the peak wavelength λ1 is located at a shorter wavelength than the half-value wavelength λ2.

2. The image forming apparatus according to claim 1, wherein a peak wavelength of infrared light emitted from the infrared irradiation unit is substantially equal to a peak wavelength of an absorption wavelength of the cationic polymerizable monomer.

3. The image forming apparatus according to claim 1, wherein the liquid developer comprises:

the cationic polymerizable monomer, a photopolymerization initiator and a toner particle that comprises the colorant and that is insoluble in the cationic polymerizable monomer, wherein the cationic polymerizable monomer is a vinyl ether compound, and the photopolymerization initiator is a compound represented by formula (1):

(1)

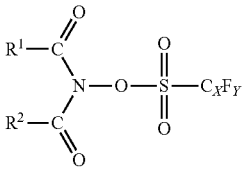

where $R^1$ and $R^2$ are bound to each other to form a ring structure, X represents an integer of 1 to 8, and Y represents an integer of 3 to 17.

4. The image forming apparatus according to claim 1, wherein the cationic polymerizable monomer is a compound selected from the group consisting of dicyclopentadiene vinyl ether, cyclohexanedimethanol divinyl ether, tricyclodecane vinyl ether, trimethylolpropane trivinyl ether, 2-ethyl-1,3-hexanediol divinyl ether, 2,4-diethyl-1,5-pentanediol divinyl ether, 2-butyl-2-ethyl-1,3-propanediol divinyl ether, neopentyl glycol divinyl ether, pentaerythritol tetravinyl ether and 1,2-decanediol divinyl ether.

5. An image forming method comprising:

a step of irradiating with infrared light a recording medium bearing a liquid developer comprising a colorant and a cationic polymerizable monomer having a C—H bond, and thereafter irradiating the liquid developer with ultraviolet light to thereby fix the liquid developer to the recording medium, wherein when a peak wavelength due to the C—H bond in an infrared absorption spectrum of the cationic polymerizable monomer is defined as λ1 and a half-value wavelength at which a spectral radiant energy density of the infrared light is 50%, when two of such half-value wavelengths are present, a half-value wavelength at a longer wavelength, is defined as λ2, the peak wavelength λ1 is located at a shorter wavelength than the half-value wavelength λ2, and a wavelength distribution of the infrared light overlaps an absorption wavelength distribution of the cationic polymerizable monomer.

6. The image forming method according to claim 5, wherein a peak wavelength of the infrared light is substantially equal to a peak wavelength of an absorption wavelength of the cationic polymerizable monomer.

7. The image forming method according to claim 5, wherein the liquid developer comprises:

the cationic polymerizable monomer, a photopolymerization initiator and a toner particle that comprises the colorant and that is insoluble in the cationic polymerizable monomer, wherein the cationic polymerizable monomer is a vinyl ether compound, and the photopolymerization initiator is a compound represented by formula (1):

(1)

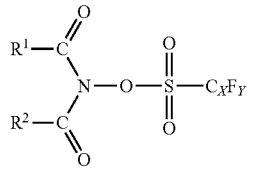

where $R^1$ and $R^2$ are bound to each other to form a ring structure, X represents an integer of 1 to 8, and Y represents an integer of 3 to 17.

8. The image forming method according to claim 5, wherein the cationic polymerizable monomer is a compound selected from the group consisting of dicyclopentadiene vinyl ether, cyclohexanedimethanol divinyl ether, tricyclodecane vinyl ether, trimethylolpropane trivinyl ether, 2-ethyl-1,3-hexanediol divinyl ether, 2,4-diethyl-1,5-pentanediol divinyl ether, 2-butyl-2-ethyl-1,3-propanediol divinyl ether, neopentyl glycol divinyl ether, pentaerythritol tetravinyl ether and 1,2-decanediol divinyl ether.

9. An image forming apparatus provided with a fixing apparatus comprising:

an infrared irradiation unit for irradiating with infrared light a recording medium bearing a liquid developer comprising a colorant and a cationic polymerizable monomer having a C-H bond is placed; and an ultraviolet irradiation unit for irradiating with ultraviolet light the liquid developer, wherein when a peak wavelength due to the C-H bond in an infrared absorption spectrum of the cationic polymerizable monomer is defined as λ1 and a half-value wavelength at which a spectral radiant energy density of infrared light emitted from the infrared irradiation unit is 50%, when two of such half-value wavelengths are present, a half-value wavelength at a longer wavelength, is defined as 2, the peak wavelength λ1 is located at a shorter wavelength than the half-value wavelength λ2, and a wavelength distribution of the infrared light overlaps an absorption wavelength distribution of the cationic polymerizable monomer.

* * * * *